United States Patent [19]

Harada et al.

[11] Patent Number: 4,819,601

[45] Date of Patent: Apr. 11, 1989

[54] DIAGNOSTIC SYSTEM OF AN AIR-FUEL RATIO CONTROL DEVICE

[75] Inventors: Kenichi Harada, Susono; Nobuki Uchitani, Tokushima; Tatuyoshi Kamohara, Toyota; Koichi Satoya, Susono; Takashi Kato, Mishima, all of Japan

[73] Assignee: Toyota Jidosha Kabushiki Kaisha, Aichi, Japan

[21] Appl. No.: 181,264

[22] Filed: Apr. 12, 1988

[30] Foreign Application Priority Data

| | | | |
|---|---|---|---|
| Apr. 15, 1987 | [JP] | Japan | 62-090711 |
| Jun. 10, 1987 | [JP] | Japan | 62-143264 |
| Jun. 23, 1987 | [JP] | Japan | 62-154307 |
| Jun. 24, 1987 | [JP] | Japan | 62-155516 |

[51] Int. Cl.[4] ..... F02M 7/00; F02M 51/00; F02D 41/22; F02D 41/14

[52] U.S. Cl. ..... 123/438; 123/440; 123/489

[58] Field of Search ..... 123/438, 440, 489; 364/431.05

[56] References Cited

U.S. PATENT DOCUMENTS

| | | | |
|---|---|---|---|
| 4,651,699 | 3/1987 | Ohtaki et al. | 123/438 |
| 4,655,181 | 4/1987 | Ohtaki et al. | 123/438 |
| 4,655,182 | 4/1987 | Nakano et al. | 123/440 |
| 4,671,243 | 6/1987 | Deutsch | 123/440 |
| 4,677,955 | 7/1987 | Takao | 123/440 |
| 4,694,809 | 9/1987 | Nakano et al. | 123/440 |
| 4,753,203 | 6/1988 | Yamada | 123/440 |
| 4,759,332 | 7/1988 | Morozumi | 123/440 |
| 4,766,868 | 8/1988 | Shibata | 123/440 |

*Primary Examiner*—Raymond A. Nelli

*Attorney, Agent, or Firm*—Parkhurst, Oliff & Berridge

[57] ABSTRACT

A diagnostic system of an air-fuel ratio control device including an $O_2$ sensor and an air bleed control valve actuated in response to a signal output by the $O_2$ sensor. When the electric control current fed into the air bleed control valve reaches an upper limit or lower limit and remains at the upper limit or lower limit for a fixed time, the diagnostic system determines that the air-fuel ratio control device has malfunctioned. When the temperature of the engine cooling water is high, a diagnosis is prohibited, to prevent an incorrect diagnosis.

23 Claims, 12 Drawing Sheets

DIAGNOSTIC SYSTEM OF AN AIR-FUEL RATIO CONTROL DEVICE

BACKGROUND OF THE INVENTION

1. Field of the Invention

The present invention relates to a diagnostic system of an air-fuel ratio control device for use in an automobile engine.

2. Description of the Related Art

In an engine equipped with an air-fuel ratio control device for maintaining the air-fuel ratio of air-fuel mixture fed into the engine cylinders at the stoichiometric air-fuel ratio, if the air-fuel ratio control device malfunctions, the air-fuel mixture becomes lean or rich. In this case, if the air-fuel mixture becomes considerably lean, the output power of the engine is reduced and the driver becomes aware that a malfunction has occurred. However, if the air-fuel mixture becomes slightly lean or excessively rich due to the malfunction, the driver is not aware of a malfunction and continues to operate the engine. This results in a problem in that a large amount of harmful components such as CO, HC and $NO_X$ will be discharged from the engine. To eliminate this problem, the present applicant has already proposed a diagnostic system which determines whether or not the air-fuel ratio control device has malfunctioned by determining whether the air-fuel fuel mixture should become lean or rich on the basis of a feedback control signal (Japanese Patent Application No. 61-243217).

However, in an engine equipped with a carburetor, if the temperature of the carburetor becomes high, percolation takes place, and as a result, since fuel is forced into the intake passage from the carburetor, the air-fuel mixture becomes excessively rich. Consequently, in this case, if an attempt is made to determine whether or not the air-fuel ratio control device has malfunctioned by using the above-mentioned diagnostic system, although the air-fuel ratio control device has not malfunctioned, the determination result shows that it has malfunctioned. Namely, a problem of incorrect diagnosis may arise.

SUMMARY OF THE INVENTION

An object of the present invention is to provide a diagnostic system capable of preventing incorrect diagnosis.

According to the present invention, there is provided a diagnostic system of an air-fuel ratio control device for use in an internal combustion engine, the diagnostic system including: detecting means for detecting a temperature of the engine; diagnostic means for determining whether or not the air-fuel ratio control device has malfunctioned; and control means for controlling the diagnostic means in response to an output signal of the detecting means to prohibit a determination by the diagnostic means when the temperature of the engine exceeds a predetermined temperature.

The present invention may be more fully understood from the description of preferred embodiments of the invention set forth below, together with the accompanying drawings.

DESCRIPTION OF THE PREFERRED EMBODIMENTS

Figure 1:
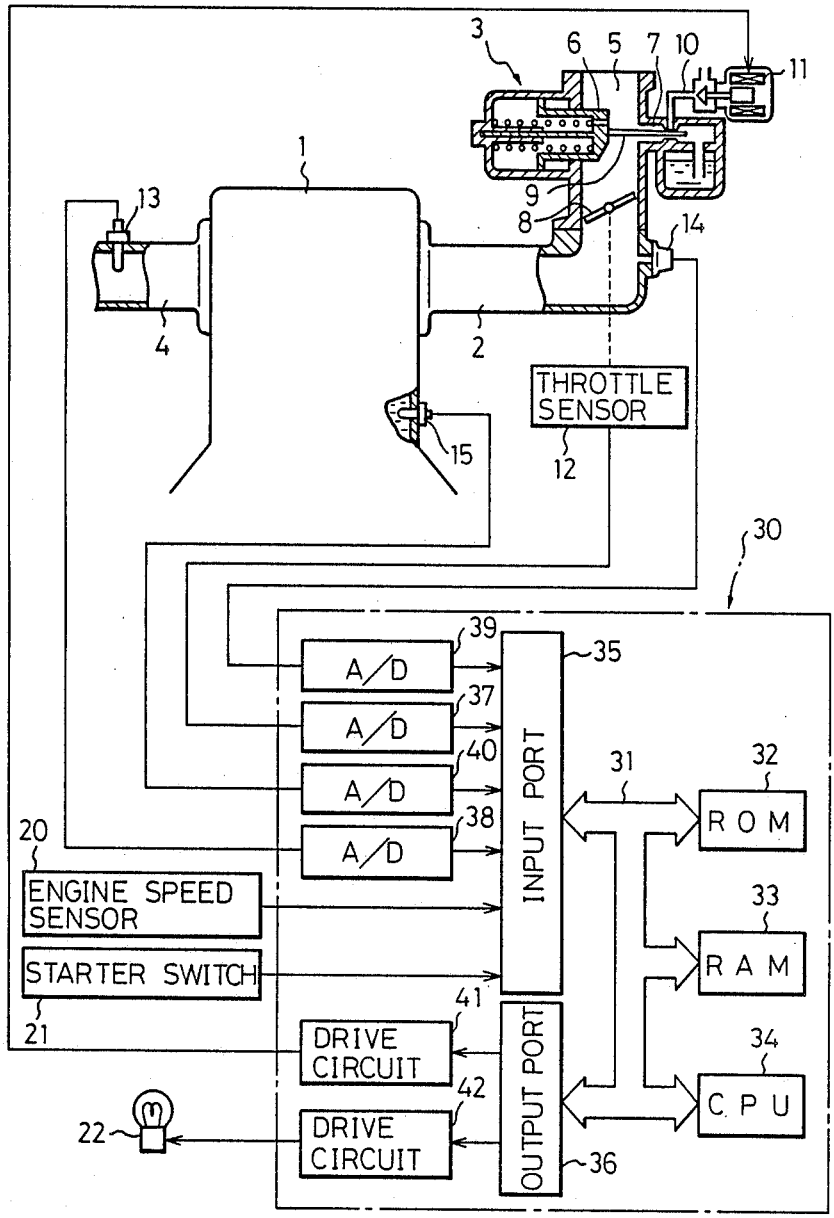
FIG. 1 is a schematically illustrated view of an engine.

Referring to FIG. 1, reference numeral 1 designates an engine body, 2 an intake manifold, 3 a variable venturi type carburetor, and 4 an exhaust manifold. The variable venturi type carburetor 3 incudes an intake passage 5, a suction piston 6, a fuel passage 7 which is open to the intake passage 5, and a throttle valve 8. The amount of fuel fed into the intake passage 5 from the fuel passage 7 is controlled by a needle 9 mounted on the suction piston 6. An air bleed passage 10 is connected to the fuel passage 7, and an air bleed control valve 11 is arranged in the air bleed passage 10. This air bleed control valve 11 is controlled on the bass of electric control current output from an electronic control unit 30. When the electric control current fed into the air bleed control valve 11 is increased, the amount of air fed into the fuel passage 7 from the air bleed passage 10 is increased, and thus the air-fuel mixture fed into the engine cylinders becomes lean. Conversely, when the control current fed into the air bleed control valve 11 is reduced, the amount of air fed into the fuel passage 7 from the air bleed passage 10 is reduced, and thus the air-fuel mixture fed into the engine cylinders becomes rich.

The electronic control unit 30 is constructed as a digital computer and includes a ROM (read only memory) 32, a RAM (random access memory) 33, a CPU (microprocessor, etc.) 34, an input port 35, and an output port 36. The ROM 32, the RAM 33, the CPU 34, the input port 35, and the output port 36 are interconnected via a bidirectional bus 31. A throttle sensor 12 producing an output voltage which is proportional to the opening degree of the throttle valve 8 is attached to the throttle valve 8, an the output voltage of the throttle sensor 12 is input to the input port 35 via an AD converter 37. An $O_2$ sensor 13 is arranged in the exhaust manifold 4, and the output signal of the $O_2$ sensor 13 is input to the input port 35 via an AD converter 38. A vacuum pressure sensor 14 producing an output voltage which is proportional to the level of vacuum in the intake manifold 2 is attached to the intake manifold 2, and the output voltage of the vacuum pressure sensor 14 is input to the input port 35 via an AD converter 39. A temperature sensor 15 producing an output voltage which is proportional to the temperature of cooling water of the engine is attached to the engine body 1, and the output voltage of the temperature sensor 15 is input to the input port 35 via an AD converter 40. In addition, an engine speed sensor 20 producing output pulses having a frequency proportional to the engine speed is connected to the input port 35, and a starter switch 21 for controlling the operation of the starter motor (not shown) is connected to the input port 35. The output port 36 is connected, on one hand, to the air bleed control valve 11 via a drive circuit 41 and, on the other hand, to a warning lamp 22 via a drive circuit 42.

Figure 3:
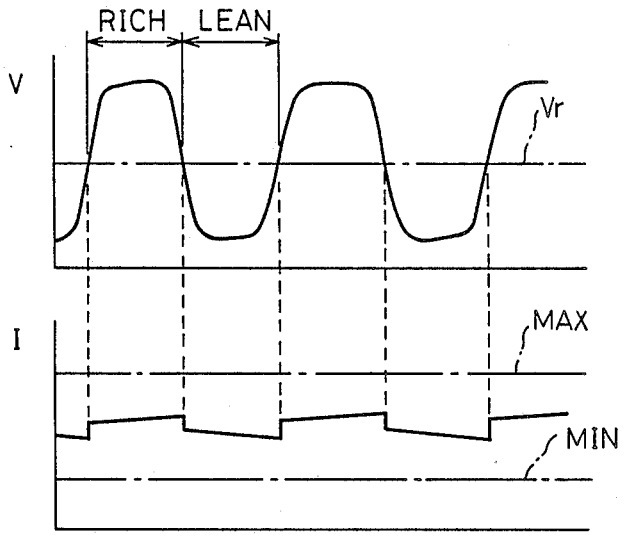
FIG. 3 is a diagram illustrating the output signal of the $O_2$ sensor and the control current I.

FIG. 3 illustrates changes in the output voltage V of the $O_2$ sensor 13. The $O_2$ sensor 13 produces the output voltage V of about 0.9 volt when the air-fuel mixture is rich, and produces the output voltage V of about 0.1 volt when the air-fuel mixture is lean. The output voltage V of the $O_2$ sensor 13 is compared with a reference voltage Vr of about 0.45 volt in the CPU 34. At this time, if the output voltage V of the $O_2$ sensor 13 is higher than Vr, the air-fuel mixture is considered rich, and if the outputvoltage V of the $O_2$ sensor 13 is lower than Vr, the air-fuel mixture is considered lean.

Figure 2:
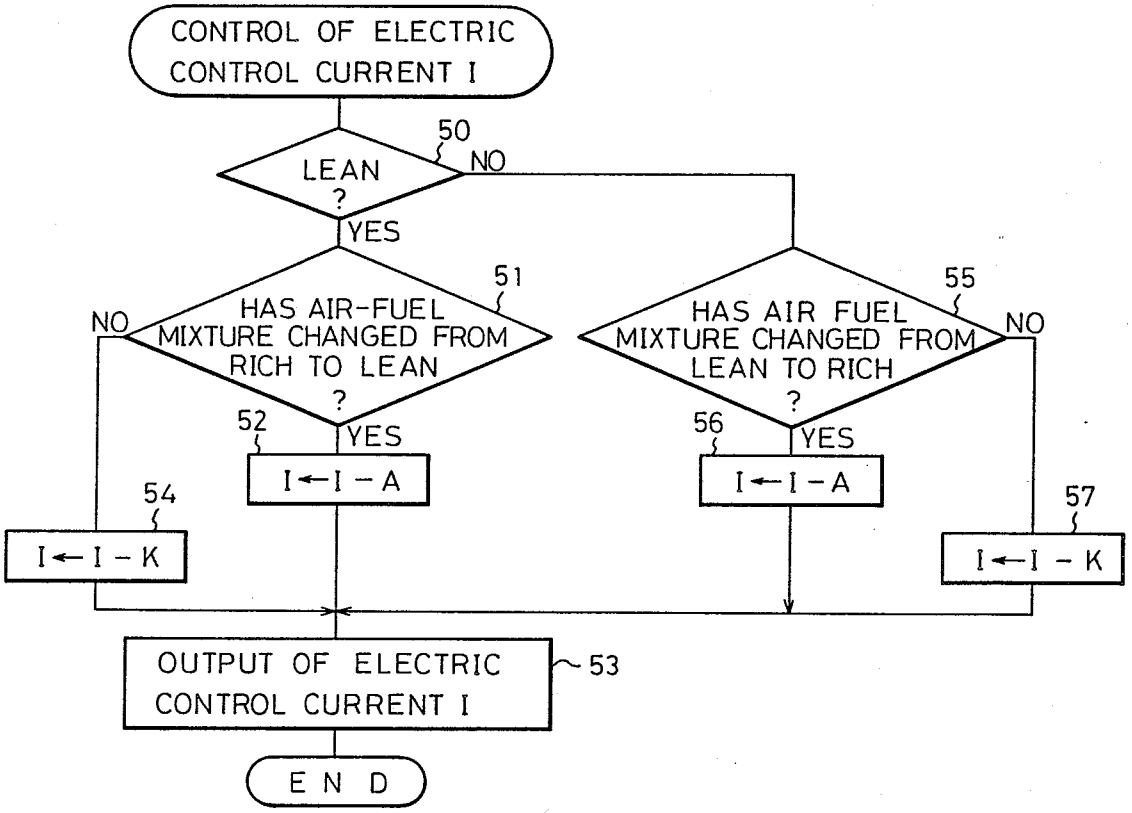
FIG. 2 is a flow chart for executing the calculation of the control current I.

FIG. 2 illustrates a routine for the calculation of the electric control current I of the air bleed control valve 11, which calculation is carried out on the basis of a determination of whether the air-fuel mixture is rich or lean.

Referring to FIG. 2, in step 50, it is determined whether or not the air-fuel mixture is lean. When the air-fuel mixture is lean, the routine goes to step 51, and it is determined whether the air-fuel mixture has been changed from rich to lean after completion of the preceding processing cycle. When the air-fuel mixture has been changed from rich to lean, the routine goes to step 52, and a skip value A is subtracted from I. Then, the routine goes to step 53. When the air-fuel mixture has not been changed from rich to lean after completion of the preceding processing cycle, the routine goes to step 54, and an integration value $K(K<<A)$ is subtracted from I. Then, the routine goes to step 53.

When it is determined in step 50 that the air-fuel mixture is rich, the routine goes to step 55, and it is determined whether the air-fuel mixture has been changed from lean to rich after completion of the preceding processing cycle. When the air-fuel mixture has been changed from lean to rich, the routine goes to step 56, and the skip value A is added to I. Then, the routine goes to step 53. When the air-fuel mixture has not been changed from lean to rich after completion of the preceding processing cycle, the routine goes to step 57, and the integration value K is added to I. Then, the routine goes to step 53. In step 53, I is output to the output port 36.

Consequently, as illustrated in FIG. 3, when the air-fuel mixture is changed from rich to lean, the value of I is abruptly reduced by the skip value A and then gradually reduced. Conversely, when the air-fuel mixture is changed from lean to rich, the value of I is abruptly increased by the skip value A and then gradually increased. The value of I calculated in each step 52, 54, 56, 57 and output to the output port 36 in step 53 in FIG. 2 represents a duty cycle of pulse, and the signal pulses which are produced at a fixed frequency and have a pulse width changed in accordance with the duty cycle are fed into the air bleed control valve 11. The opening degree of the air bleed control valve 11 is controlled in response to the mean value of electric current of the serial pulse and, therefore, I is used as the control electric current of the air bleed control valve 11. The range of the control current I which is able to control an air-fuel ratio is between the minimum value MIN and the maximum value MAX in FIG. 3, and the control current I normally moves up and down between MIN and MAX while the feedback control is carried out. However, if the air-fuel mixture remains excessively rich the control electric current I is increased and reaches MAX and, if the air-fuel mixture remains excessively lean, the control electric current I is reduced and reaches MIN. Consequently, it is possible to determine whether or not the air-fuel ratio control device is in an abnormal state on the basis of a determination of whether the control electric current I becomes equal to MAX or MIN.

Figure 4:
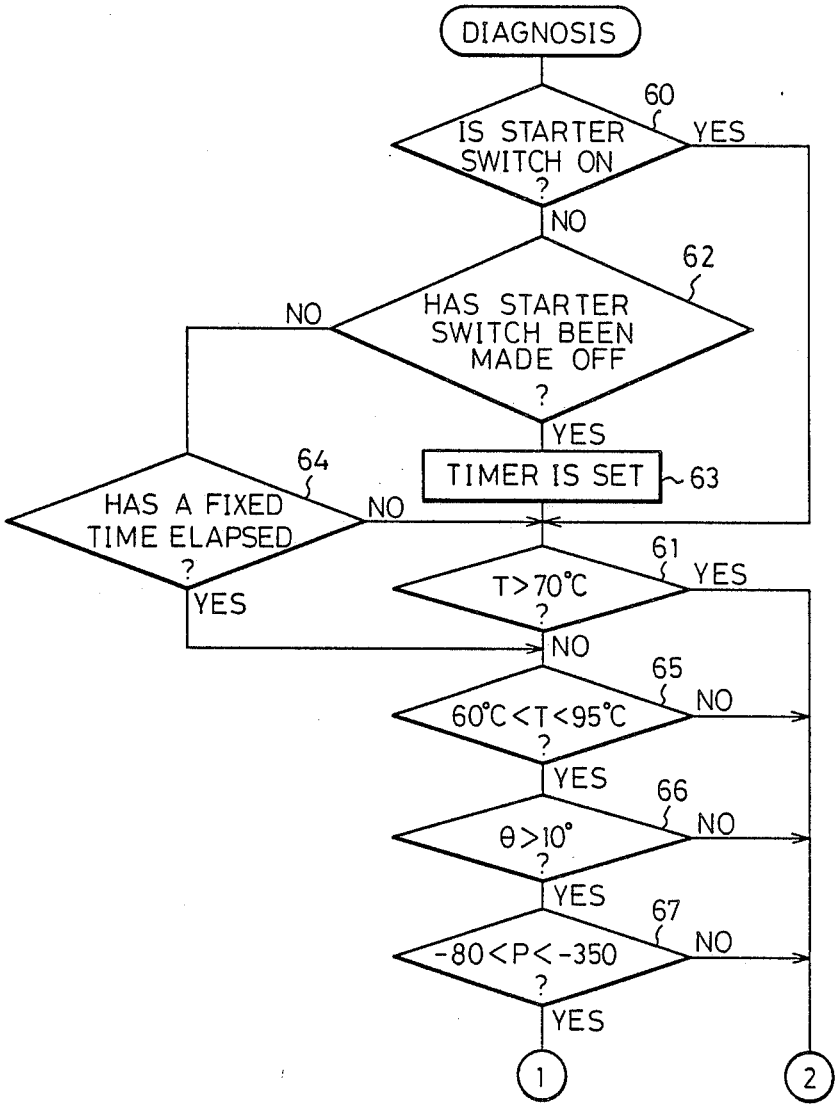
FIGS. 4 and 5 are a flow chart of first embodiment of processing for executing the diagnosis.
Figure 5:
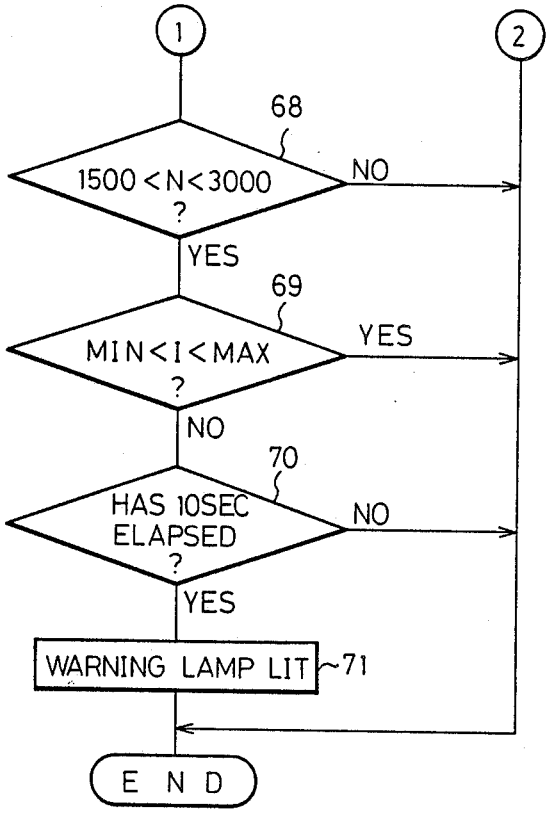

FIGS. 4 and 5 are a flow chart for executing a diagnosis of the air-fuel ratio control device. The routine illustrated in FIGS. 4 and 5 is processed by sequential interruptions which are executed at predetermined intervals.

Referring to FIGS. 4 and 5, in step 60, it is determined whether or not the starter switch 21 is ON. When the starter switch 21 is ON, the routine jumps to step 61. Conversely, when the starter switch 21 is OFF, the routine goes to step 62, and it is determined whether or not the starter switch 21 has been made OFF after completion of the preceding processing cycle. If the starter switch 21 has been made OFF after completion of the preceding processing cycle, the routine goes to step 63, and the timer is set, that is, the time is operated. Then, the routine goes to step 61. If the starter switch 21 has not been made OFF after completion of the preceding processing cycle, the routine goes to step 64, and it is determined whether or not a fixed time has elapsed after the timer was set. If the fixed time has not elapsed, that is, if the fixed time has not elapsed after the engine is started, the routine goes to step 61. Conversely, if the fixed time has elapsed after the engine is started, the routine goes to step 65.

In step 61, it is determined whether or not the temperature T of the engine cooling water is higher than a predetermined temperature, for example, 70° C., on the basis of the output signal of the temperature sensor 15. If $T>70°$ C., the processing cycle is completed. Consequently, at this time, a diagnosis is not made. Namely, if the temperature T of the engine cooling water is higher than 70° C. when the engine is started or immediately after the engine is started, the temperature of the carburetor 3 is considered to be very high. Consequently, at this time, since percolation may be generated, the diagnosis is prohibited to prevent an incorrect diagnosis. Conversely, if $T\leqq 70°$ C., the routine goes to step 65. Consequently, when the temperature T of the engine cooling water is lower than 70° C. before the fixed time has elapsed after the engine is started, or after the fixed time has elapsed after the engine is started, the routine goes to step 65.

In steps 65, 66, 67, 68, it is determined whether or not the engine is operating in a state wherein a diagnosis should be made, and when the diagnosis is made in step 69 and 70 and it is determined that the air-fuel ratio control device has malfunctioned, the process goes to step 71 and the warning lamp 22 is lit.

Namely, in step 65, it is determined whether or not the temperature T of the engine cooling water is higher than 60° C. and lower than 95° C. If $T\leqq 60°$ C., or if $T\geqq 95°$ C., the processing cycle is completed. Consequently, at this time, a diagnosis is not made. When $T\leqq 60°$ C., the air-fuel mixture is sometimes made rich due to the operation of the choke valve. Consequently, at this time, the diagnosis is prohibited to prevent an incorrect diagnosis. Consequently, where the fixed time has not elapsed after the engine is started, the diagnosis is made only when $60° C.<T<70° C$. Conversely, where the fixed time has elapsed after the engine is started, the diagnosis is made only when 60° C.<-T<95° C. When the fixed time has elapsed after the engine is started, if T≧95° C., percolation may occur in the carburetor 3. Consequently, in this case, the diagnosis is prohibited to prevent an incorrect diagnosis. As mentioned above, the cooling water temperature 95° C. at which the percolation will occur when the fixed time has elapsed after the engine is started is higher than the cooling water temperature 70° C. at which the percolation will occur immediately after the engine is started. This is because, if a vehicle is driven after the fixed time has elapsed after the engine is started, the carburetor 3 is cooled by air flowing into the engine compartment and thus the temperature of the carburetor 3 will be reduced.

In step 66, it is determined whether or not the opening degree $\theta$ of the throttle valve 8 exceeds 10°, on the basis of the output signal of the throttle sensor 12 and, in step 67, it is determined whether or not the level of vacuum P in the intake manifold 2 is larger than −80 mmHg and smaller than −350 mmHg, on the basis of the output signal of the vacuum pressure sensor 14. In addition, in step 68, it is determined whether or not the engine speed N is higher than 1500 r.p.m. and lower than 3000 r.p.m., on the basis of the output signal of the engine speed sensor 20. As will be understood from steps 66, 67, and 68, when the amount of air fed into the engine cylinders is small, and thus the sensitivity of the air bleed operation is low, and when the engine is operating at a high speed and thus an air-fuel ratio necessary to ensure an output of a high power is required, the diagnosis is prohibited to prevent an incorrect diagnosis.

In step 69, it is determined whether or not the control electric current I is larger than MIN and smaller than MAX. If I≦MIN, or if I≧MAX, the routine goes to step 70, and it is determined whether or not the state of I≦MIN, or if I≧MAX has continued for more than 10 sec. If this state has continued for more than 10 sec, it is determined that the air-fuel ratio control device has malfunctioned. At this time, the routine goes to step 71, and the warning lamp 22 is lit.

As mentioned above, in this embodiment, when the engine is operating in a state wherein percolation is likely to occur in the carburetor, since the diagnosis is prohibited, it is possible to prevent an incorrect diagnosis from being made.

Figure 6:
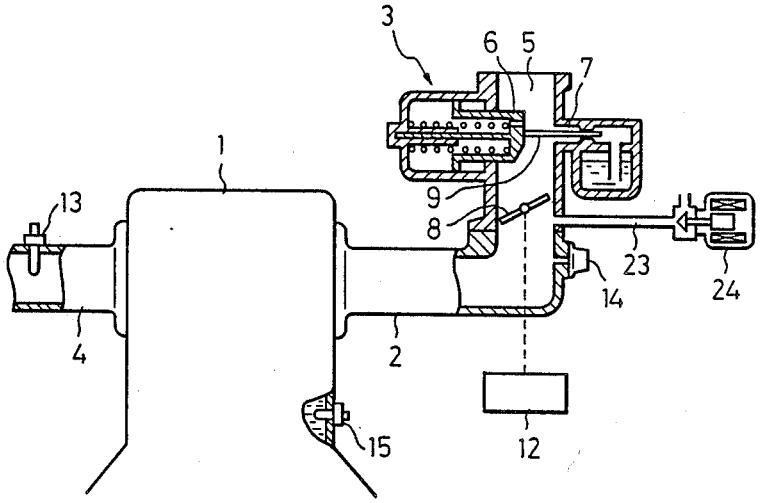
FIG. 6 is a schematically illustrated view of an alternative embodiment of the engine.

FIG. 6 illustrates an alternative embodiment of the air-fuel ratio control device. In this embodiment, an air supply passage 23 is connected to the intake passage 5 downstream of the throttle valve 8, and an air control valve 24 is arranged in the air supply passage 23. This air control valve 24 is controlled on the basis of a control electric current output from the electronic control unit 30 (FIG. 1). When the control electric current fed into the air control valve 24 is increased, the amount of air fed into the intake passage 5 from the air supply passage 23 is increased, and thus the air-fuel mixture fed into the engine cylinders becomes lean. Conversely, when the control electric current fed into the air control valve 24 is reduced, the amount of air fed into the intake passage 5 from the air supply passage 23 is reduced, and thus the air-fuel mixture fed into the engine cylinders becomes rich.

Also in this embodiment, the range of the control current I which is able to control an air-fuel ratio is between the minimum value MIN and the maximum value MAX in FIG. 3, and the control current I normally moves up and down between MIN and MAX while the feedback control is carried out. However, if the air-fuel mixture remains excessively rich, the control electric current I is increased and reaches MAX and, if the air-fuel mixture remains excessively lean, the control electric current I is reduced and reaches MIN. Consequently, it is possible to determine whether or not the air-fuel ratio control device is in an abnormal state on the basis of a determination of whether the control electric current I has become equal to MAX or MIN.

In the embodiments illustrated in FIGS. 1 and 6, when the cooling water temperature is high, the diagnosis is prohibited. Namely, since when the cooling water temperature is reduced, the temperature of the carburetor 3 is accordingly reduced, the diagnosis is started when the cooling water temperature becomes lower than a temperature at which percolation will not occur in the carburetor 3. However, since the carburetor is not directly cooled by the cooling water, but cooled only by the wind flowing into the engine compartment, once the temperature of the carburetor becomes extremely high, it is not always rapidly reduced even though the temperature of the engine cooling water has rapidly fallen. Consequently, in certain engines, even if the temperature of the engine cooling water becomes low, percolation may occur. In this case, if the diagnosis is started when the temperature of the engine cooling water becomes low, an incorrect diagnosis may be made.

FIGS. 7 through 12 illustrate three different embodiments of the present invention, all of which are capable of further preventing an incorrect diagnosis.

Figure 7:
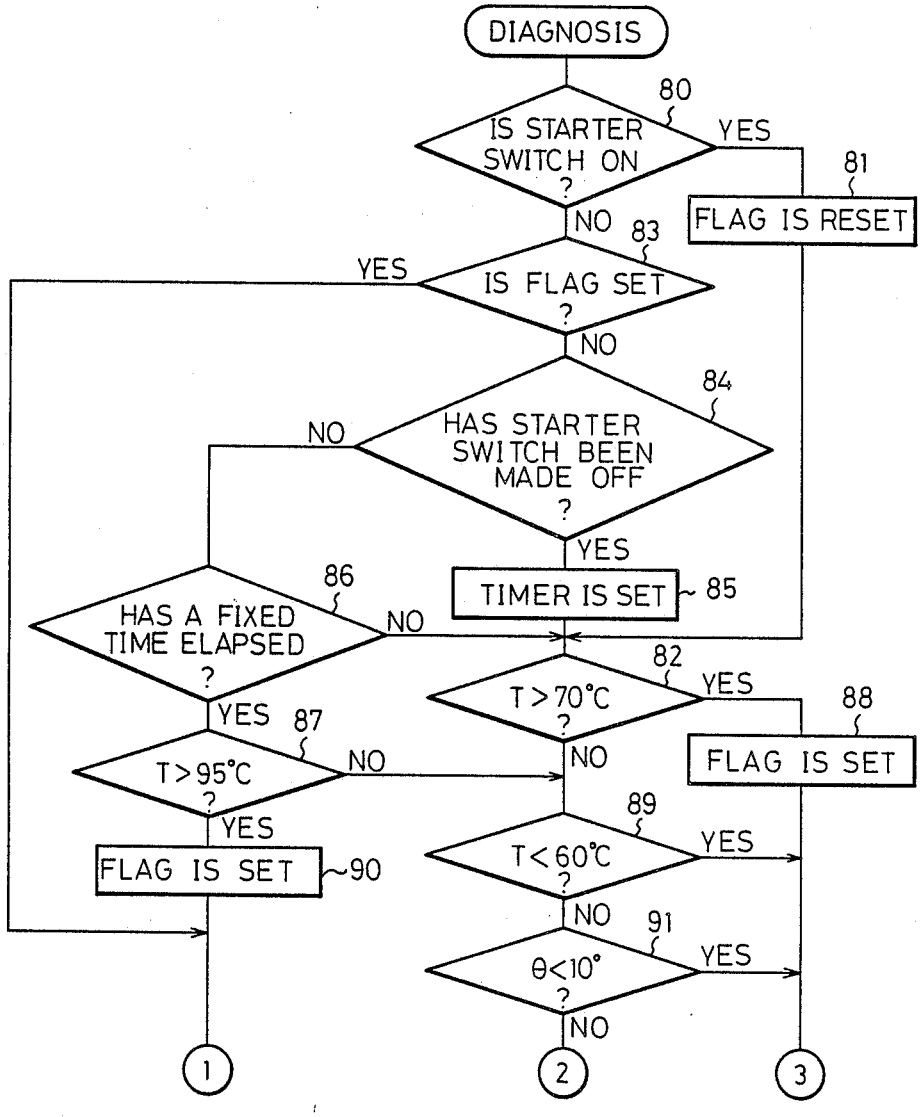
FIGS. 7 and 8 are a flow chart of a second embodiment of processing for executing the diagnosis.
Figure 8:
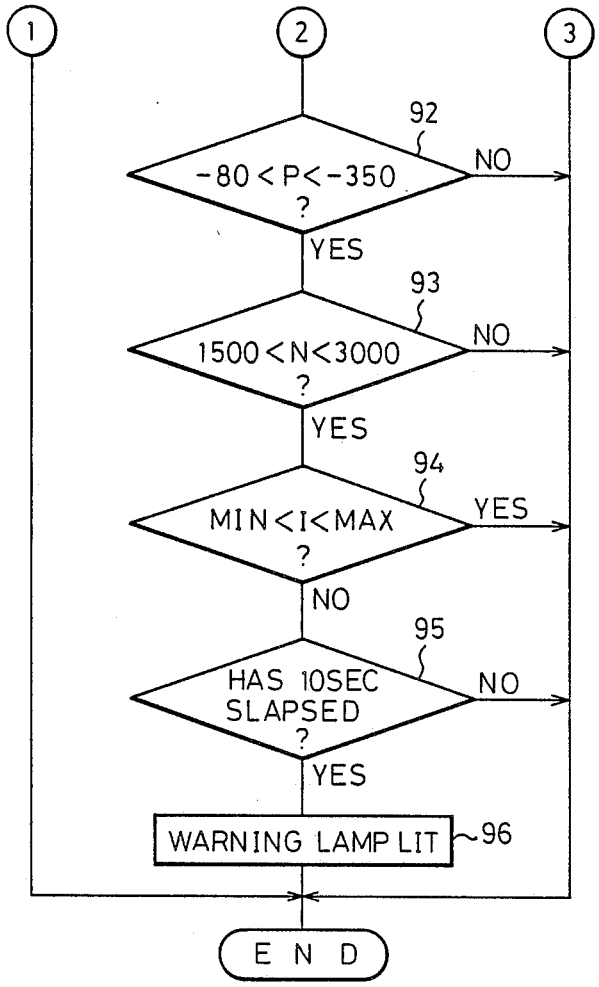

FIGS. 7 and 8 are a flow chart of another embodiment for executing a diagnosis of the air-fuel ratio control device. The routine illustrated in FIGS. 7 and 8 is processed by sequential interruptions which are executed at predetermined intervals.

Referring to FIGS. 7 and 8, in step 80, it is determined whether or not the starter switch 21 is ON. When the starter switch 21 is ON, the routine goes to step 81, and a flag is reset. Then, the routine goes to step 82. As hereinafter described, this flag is set when the temperature of the cooling water of the engine is higher than a predetermined temperature. Conversely, when the starter switch 21 is made OFF, the routine goes to step 83 from step 80, and it is determined whether the flag is set. If the flag is set, the processing routine is completed. Conversely, if the flag is reset, the routine goes to step 84, and it is determined whether or not the starter switch 21 has been made OFF after completion of the preceding processing cycle. If the starter switch 21 has been made OFF after completion of the preceding processing cycle, the routine goes to step 85, and the timer is set, that is, the timer is operated. Then, the routine goes to step 82. If the starter switch 21 has not been made OFF after completion of the preceding processing cycle, the routine goes to step 86, and it is determined whether or not a fixed time has elapsed after the timer is set. If the fixed time has not elapsed, that is, if the fixed time has not elapsed after the engine is started, the routine goes to step 82. Conversely, if the fixed time has elapsed after the engine is started, the routine goes to step 87.

In step 82, it is determined whether or not the temperature T of the engine cooling water is higher than a predetermined temperature, for example, 70° C., on the basis of the output signal of the temperature sensor 15. If T>70° C., the routine goes to step 88, and the flag is set. Then, the processing cycle is completed. Once the flag is set, the flag remains set as long as the engine is operated. As can be seen from FIGS. 7 and 8, when the flag is set, the processing cycle is instantaneously completed via step 83. Consequently, once the flag is set, a diagnosis is not made as long as the engine is operated. That is, if the temperature T of the engine cooling water is higher than 70° C. when the engine is started or immediately after the engine is started, the temperature of the carburetor 3 is considered to be very high. Consequently, at this time, percolation may be generated. In addition, even if the temperature T of the engine cooling water becomes low thereafter, the temperature of the carburetor 3 does not always becomes low in accordance with a reduction in the temperature T of the engine cooling water. Consequently, even if the temperature T of the engine cooling water becomes lower than 70° C., percolation may be generated. Consequently, when the temperature T of the engine cooling water is higher than 70° C. when the engine is started or immediately after the engine is started, a diagnosis is thereafter prohibited to prevent an incorrect diagnosis due to the generation of percolation. When it is determined in step 82 that $T \leqq 70°$ C., the routine goes to step 89 and the flag is not set.

In step 86, if it is determined that the fixed time has elapsed after the engine is started, the routine goes to step 87, and it is determined whether or not the temperature T of the engine cooling water is higher than a predetermined temperature, for example, 95° C. If $T > 95°$ C., the routine goes to step 90, and the flag is set. Consequently, a diagnosis is prohibited as long as the engine is operated thereafter. That is, if the temperature T of the engine cooling water is higher than 95° C. when the fixed time has elapsed after the engine is started, the temperature of the carburetor 3 is considered to be very high. Consequently, at this time, percolation may be generated. In addition, even if the temperature T of the engine cooling water becomes low thereafter, the temperature of the carburetor 3 does not always become low in accordance with a reduction in the temperature T of the engine cooling water. Consequently, even if the temperature T of the engine cooling water becomes lower than 95° C., percolation may be generated. Consequently, when the temperature T of the engine cooling water is higher than 95° C. after the fixed time has elapsed after the engine is started, the diagnosis is thereafter prohibited to prevent an incorrect diagnosis due to the generation of percolation.

As mentioned above, the cooling water temperature 95° C. at which the percolation will occur when the fixed time has elapsed after the engine is started is higher than the cooling water temperature 70° C. at which the percolation will occur immediately after the engine is started. This is because, as already mentioned, if a vehicle is driven when the fixed time has elapsed after the engine is started, the carburetor 3 is cooled by air flowing into the engine compartment, and thus the temperature of the carburetor 3 will be reduced.

When it is determined is step 87 that $T \leqq 95°$ C., the routine goes to step 89. Consequently, when the temperature T of the engine cooling water does not exceed 70° C. before the fixed time has elapsed after the engine is started, or when the temperature T of the engine cooling water does not exceed 95° C. after the fixed time has elapsed after the engine is started, the routine goes to step 89.

In steps 89, 91, 92, and 93, it is determined whether or not the engine is operating in a state wherein a diagnosis should be made, and when the diagnosis is made in steps 94 and 95 and it is determined that the air-fuel ratio control device has malfunctioned, the process goes to step 96 and the warning lamp 22 is lit.

That is, in step 89, it is determined whether or not the temperature T of the engine cooling water is lower than 60° C. If $T \leqq 60°$ C., the processing cycle is completed. Consequently, at this time, a diagnosis is not made. When $T \leqq 60°$ C., the air-fuel mixture may remain rich due to the operation of the choke valve. Consequently, at this time, the diagnosis is stopped to prevent an incorrect diagnosis. Consequently, where the fixed time has not elapsed after the engine is started, the diagnosis is made only when $60° C. < T < 70°$ C. In addition, once the temperature T of the engine cooling water exceeds 70° C., the diagnosis is not made. Conversely, where the fixed time has elapsed after the engine is started, the diagnosis is made only when $60° C. < T < 95°$ C. In addition, once the temperature T of the engine cooling water exceeds 95° C., the diagnosis is not made.

In step 91, it is determined whether or not the opening degree 8 of the throttle valve 8 is smaller than 10°, on the basis of the output signal of the throttle sensor 12 and, in step 92, it is determined whether or not the level of vacuum P in the intake manifold 2 is larger than −80 mmHg and smaller than −350 mmHg, on the basis of the output signal of the vacuum pressure sensor 14. In addition, in step 93, it is determined whether or not the engine speed N is higher than 1500 r.p.m. and lower than 3000 r.p.m., on the basis of the output signal of the engine speed sensor 20.

Then, in step 94, it is determined whether or not the control electric current I is larger than MIN and smaller than MAX. If $I \leqq MIN$, or if $I \geqq MAX$, the routine goes to step 95, and it is determined whether or not the state of $I \leqq MIN$ or $I \geqq MAX$ has continued for more than 10 sec. If the state has continued for more than 10 sec, it is determined that the air-fuel ratio control device has malfunctioned. At this time, the routine goes to step 96, and the warning lamp 22 is lit.

As mentioned above, in this embodiment, when the engine is operating in a state where percolation may occur in the carburetor even if the temperature of the engine cooling water becomes low, since the diagnosis is prohibited, it is possible to prevent an incorrect diagnosis from being made.

Figure 9:
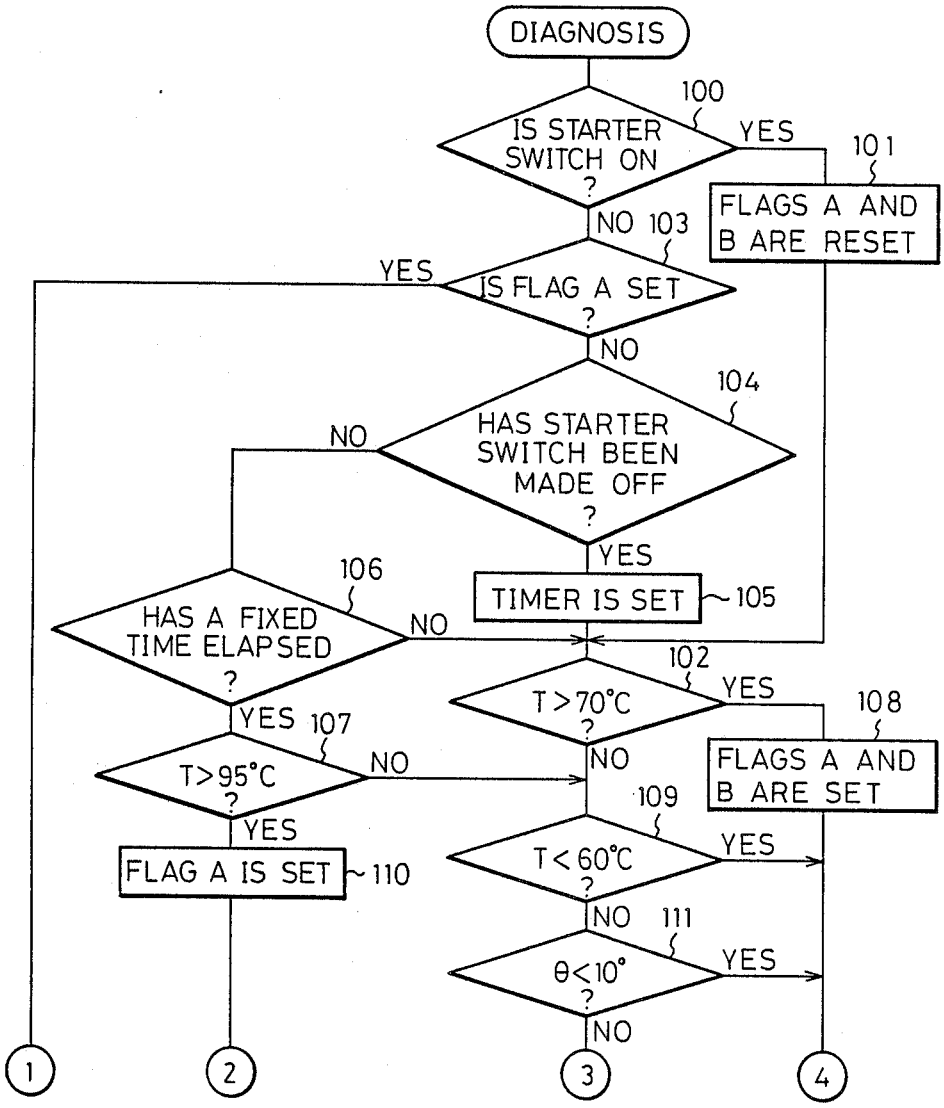
FIGS. 9 and 10 are a flow chart of a third embodiment of processing for executing the diagnosis.
Figure 10:
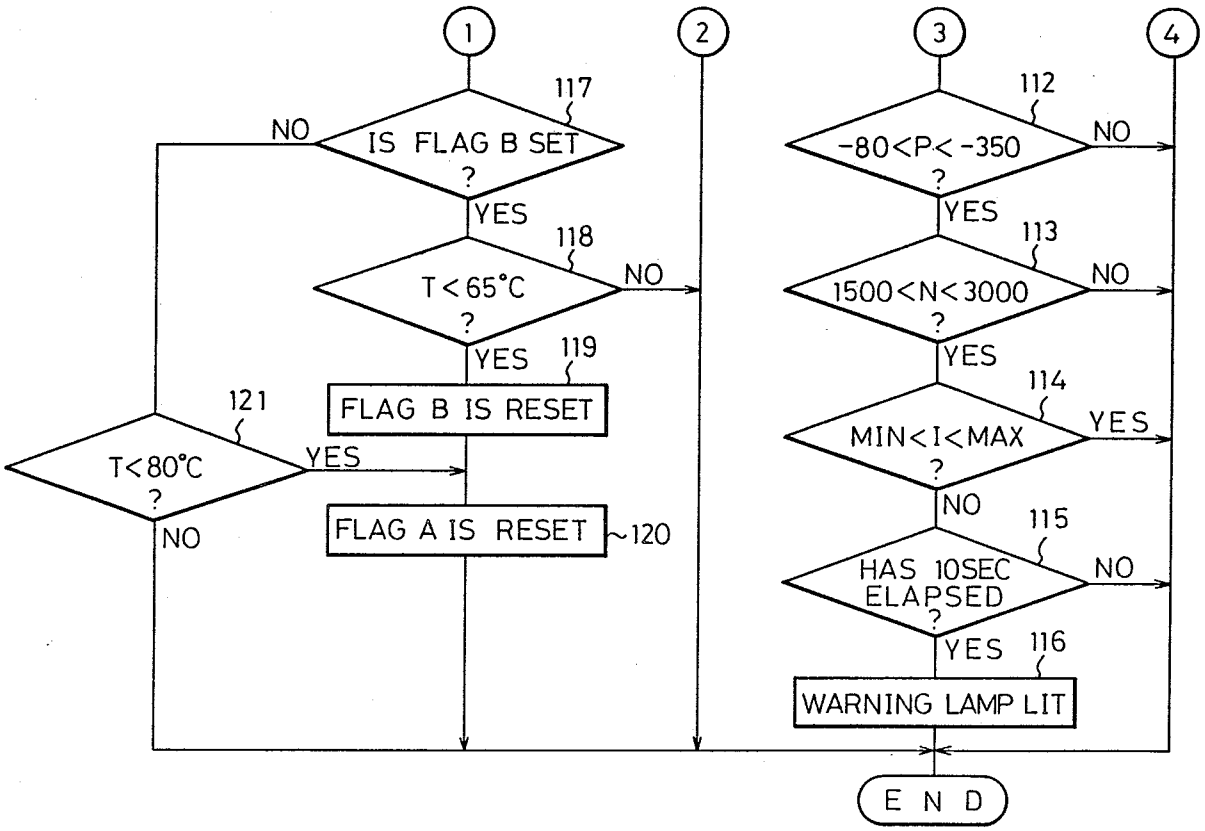

FIGS. 9 and 10 are a flow chart of a further embodiment for executing a diagnosis of the air-fuel ratio control device. The routine illustrated in FIGS. 9 and 10 is processed by sequential interruptions which are executed at predetermined intervals.

Referring to FIGS. 9 and 10, in step 100, it is determined whether or not the starter switch 21 is ON. When the starter switch 21 is ON, the routine goes to step 101, and flags A and B are reset. Then, the routine goes to step 102. As hereinafter described, the flag A is set when the temperature of the engine cooling water is higher than a predetermined temperature, and the flag B is set when the temperature of the engine cooling water is higher than a predetermined temperature before a fixed time has elapsed after the engine is started.

When the starter switch 21 is made OFF, the routine goes to step 103 from step 100, and it is determined whether the flag A is set. If the flag A is reset, the routine goes to step 104, and it is determined whether or not the starter switch 21 has been made OFF after completion of the preceding processing cycle. If the starter switch 21 has been made OFF after completion of the preceding processing cycle, the routine goes to step 105, and the timer is set, that is, the timer is operated. Then, the routine goes to step 102. If the starter switch 21 has not been made OFF after completion of the preceding processing cycle, the routine goes to step 106, and it is determined whether or not a fixed time has elapsed after the timer is set. If the fixed time has not elapsed, that is, if the fixed time has not elapsed after the engine is started, the routine goes to step 102. Conversely, if the fixed time has elapsed after the engine is started, the routine goes to step 107.

In step 102, it is determined whether or not the temperature T of the engine cooling water is higher than a first predetermined temperature, for example, 70° C., on the basis of the output signal of the temperature sensor 15. If T>70° C., the routine goes to step 108, and the flags A and B are set. Then, the processing cycle is completed. Once the flag A is set, the flag A remains set until the temperature T of the engine cooling water falls to a certain extent. During this time, the diagnosis is not made. That is, if the temperature T of the engine cooling water is higher than the 70° C. when the engine is started or immediately after the engine is started, the temperature of the carburetor 3 is considered to be very high. Consequently, at this time, since percolation may be generated, the diagnosis is prohibited to prevent an incorrect diagnosis. Conversely, if T≦70° C., the routine goes to step 109 from step 102 and the flags A and B are not set.

In step 106, if it is determined that the fixed time has elapsed after the engine is started, the routine goes to step 107, and it is determined whether or not the temperature T of the engine cooling water is higher than another first predetermined temperature, for example, 95° C.. If T>95° C., the routine goes to step 110, and the flag A is set. Consequently, the diagnosis is prohibited. Namely, if the temperature T of the engine cooling water is higher than 95° C. when the fixed time has elapsed after the engine is started, percolation may occur in the carburetor 3. Consequently, in this case, the diagnosis is prohibited to prevent an incorrect diagnosis from being made.

When it is determined in step 107 that T≦95° C., the routine goes to step 109. Consequently, when the temperature T of the engine cooling water does not exceed 70° C. before the fixed time has elapsed after the engine is started, or when the temperature T of the engine cooling water does not exceed 95° C. when the fixed time has elapsed after the engine is started, the routine goes to step 109 and the flags A and B are not set.

In steps 109, 111, 112, and 113, it is determined whether or not the engine is operating in a state wherein a diagnosis should be made, and when the diagnosis is made in steps 114 and 115, and it is determined that the air-fuel ratio control device has malfunctioned, the process goes to step 116 and the warning lamp 22 is lit.

Namely, in step 109, it is determined whether or not the temperature T of the engine cooling water is lower than 60° C. If T<60° C., the processing cycle is completed. Consequently, at this time, a diagnosis is not made. Consequently, where the fixed time has not elapsed after the engine is started, the diagnosis is made when 60° C.<T<70° C. Conversely, where the fixed time has elapsed after the engine is started, the diagnosis is made when 60° C.<T<95° C.

In step 111, it is determined whether or not the opening degree $\theta$ of the throttle valve 8 is smaller than 10° C., on the basis of the output signal of the throttle sensor 12 and, in step 112, it is determined whether or not the level of vacuum P in the intake manifold 2 is larger than −80 mmHg and smaller than −350 mmHg, on the basis of the output signal of the vacuum pressure sensor 14. In addition, in step 113, it is determined whether or not the engine speed N is higher than 1500 r.p.m. and lower than 3000 r.p.m., on the basis of the output signal of the engine speed sensor 20. Then, in step 114, it is determined whether or not the control electric current I is larger than MIN and smaller than MAX. If I≦MIN, or if I≧MAX, the routine goes to step 115, and it is determined whether or not the state of I≦MIN or I≧MAX has continued for more than 10 sec. If this state has continued for more than 10 sec, it is determined that the air-fuel ratio control device has malfunctioned. At this time, the routine goes to step 116, and the warning lamp 22 is lit.

If the flag A is set, the routine goes to step 117 from step 103, and it is determined whether or not the flag B is set. When the flag B is set, that is, when the temperature T of the engine cooling water exceeds 70° C. before the fixed time has elapsed after the engine is started, the routine goes to step 118, and it is determined whether or not the temperature T of the engine cooling water is lower than a predetermined second temperature, for example, 65° C. If T≧65° C., the processing routine is completed. Conversely, if T<65° C., the routine goes to step 119, and the flag B is reset. After this, in step 120, the flag A is reset, and then the processing cycle is completed. Consequently, if the temperature T of the engine cooling water is lower than 65° C., the routine goes to step 109 from 107 in the next processing cycle, and thus a diagnosis is made.

Even if the temperature T of the engine cooling water becomes low, the temperature of the carburetor 3 does not always becomes low in accordance with a reduction in the temperature T of the engine cooling water. Consequently, even if the temperature T of the engine cooling water is lower than 70° C., percolation may occur in the carburetor 3. However, it has been proven that, if the temperature T of the engine cooling water is reduced to a certain extent, that is, is made lower than 65° C., the temperature of the carburetor 3 is reduced to a temperature at which percolation will not occur. Consequently, when the temperature T of the engine cooling water becomes lower than 65° C., the diagnosis is started. In other words, in this embodiment, by prohibiting the diagnosis when the temperature T of the engine cooling water is higher than the second predetermined temperature 65° C., which is lower than the first predetermined temperature 70° C., an incorrect diagnosis is prevented.

If it is determined in step 117 that the flag B is reset, that is, when the temperature T of the engine cooling water exceeds 95° C. when the fixed time has elapsed after the engine is started, the routine goes to step 121, and it is determined whether or not the temperature T of the engine cooling water is lower than a predetermined other second temperature, for example, 80° C. If T≧80° C., the processing routine is completed. Conversely, if T<80° C., the routine goes to step 120, the flag A is reset, and the processing cycle is completed. Consequently, if the temperature T of the engine cooling water is lower than 80° C., the routine goes to step 109 from 107 in the next processing cycle, and thus a diagnosis is made.

As mentioned above, even if the temperature T of the engine cooling water becomes low, the temperature of the carburetor 3 does not always becomes low in accordance with a reduction in the temperature T of the engine cooling water. Consequently, even if the temperature T of the engine cooling water is lower than 95° C., percolation may occur in the carburetor 3. However, it has been proven that, if the temperature T of the engine cooling water is reduced to a certain extent, that is, becomes lower than 80° C., the temperature of the carburetor 3 is reduced to a temperature at which percolation will not occur. Consequently, when the temperature T of the engine cooling water becomes lower than 80° C., the diagnosis is started. In other words, in this embodiment, by prohibiting the diagnosis when the temperature T of the engine cooling water is higher than the other second predetermined temperature 80° C., which is lower than the other first predetermined temperature 95° C., an incorrect diagnosis is prevented. As mentioned above, the cooling water temperature 80° C. at which percolation will occur when the fixed time has elapsed after the engine is started is higher than the cooling water temperature 65° C. at which percolation will occur immediately after the engine is started. This is because, if a vehicle is driven when the fixed time has elapsed after the engine is started, the carburetor 3 is cooled by air flowing into the engine compartment, and thus the temperature of the carburetor 3 will be reduced.

In this embodiment, an incorrect diagnosis is prevented by prohibiting the diagnosis when the temperature of the engine cooling water becomes higher than a predetermined first temperature and by starting the diagnosis when the temperature of the engine cooling water becomes lower than a predetermined second temperature, which is lower than the predetermined first temperature.

Figure 11:
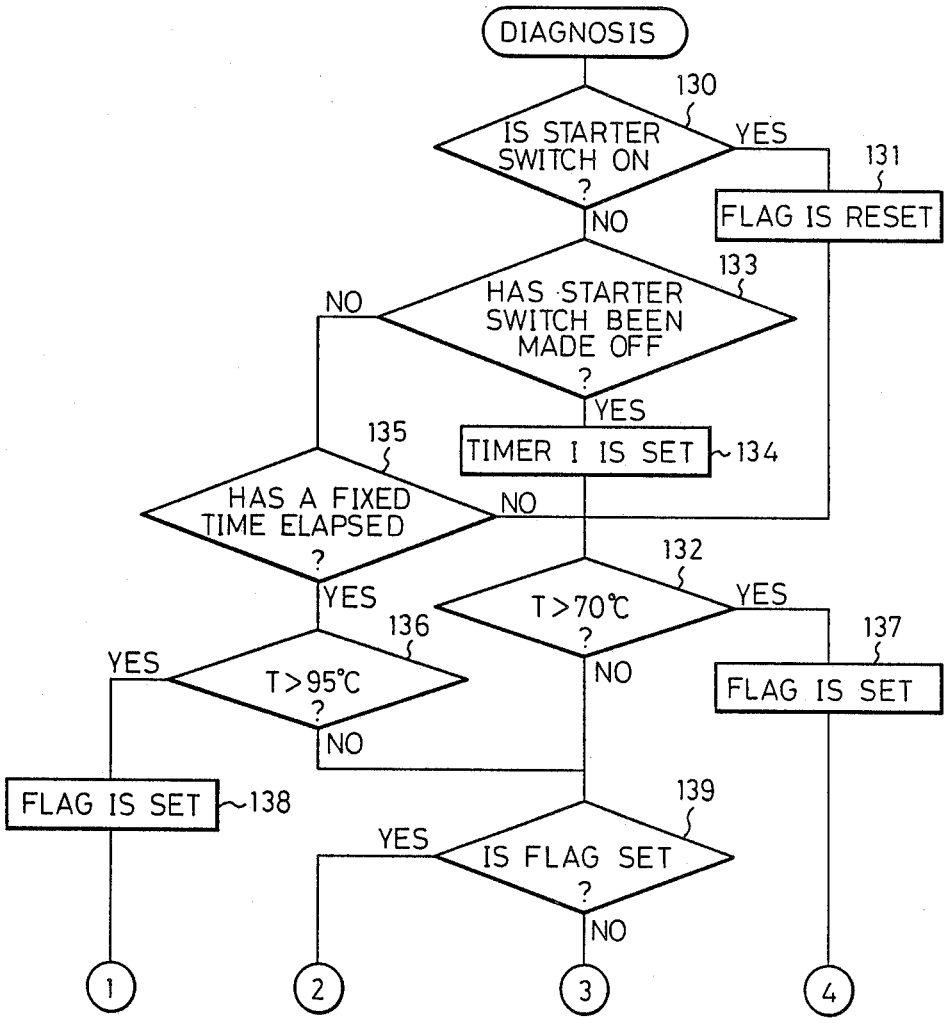
FIGS. 11 and 12 are a flow chart of a fourth embodiment of processing for executing the diagnosis.
Figure 12:
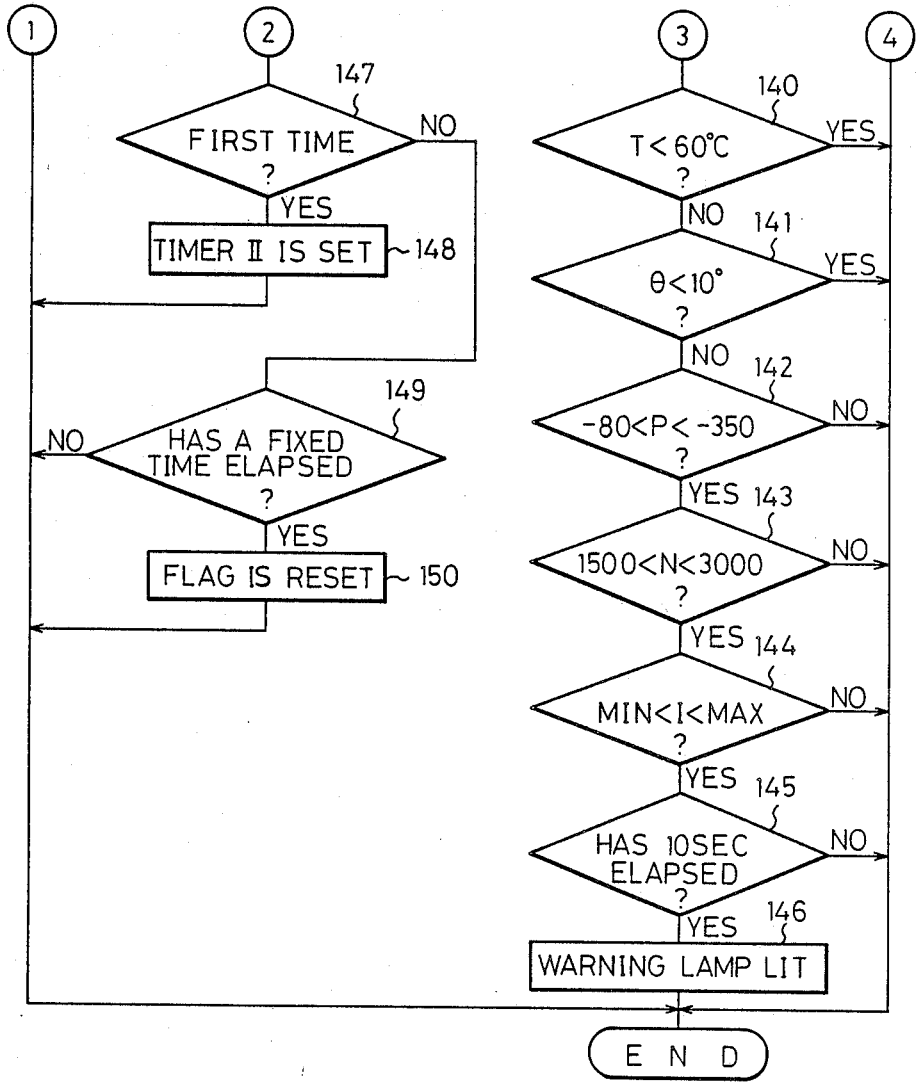

FIGS. 11 and 12 are a flow chart of a still further embodiment for executing a diagnosis of the air-fuel ratio control device. The routine illustrated in FIGS. 11 and 12 is processed by sequential interruptions which are executed at predetermined intervals.

Referring to FIGS. 11 and 12, in step 130, it is determined whether or not the starter switch 21 is ON. When the starter switch 21 is ON, the routine goes to step 131, and a flag is reset. The routine then goes to step 132. As hereinafter described, this flag is set when the temperature of the cooling water of the engine is higher than a predetermined temperature. Conversely, when the starter switch 21 is made OFF, the routine goes to step 133 from step 130, and it is determined whether or not the starter switch 21 has been made OFF after completion of the preceding processing cycle. If the starter switch 21 has been made OFF after completion of the preceding processing cycle, the routine goes to step 134, and the timer I is set, that is, the timer I is operated. Then, the routine goes to step 132. If the starter switch 21 has not been made OFF after completion of the preceding processing cycle, the routine goes to step 135, and it is determined whether or not a fixed time determined by the timer I has elapsed after the timer I is set. If the fixed time has not elapsed, that is, if the fixed time has not elapsed after the engine is started, the routine goes to step 132. Conversely, if the fixed time has elapsed after the engine is started, the routine goes to step 136.

In step 132, it is determined whether or not the temperature T of the engine cooling water is higher than a predetermined temperature, for example, 70° C., on the basis of the output signal of the temperature sensor 15. If $T>70°$ C., the routine goes to step 137, and the flag is set. Then, the processing cycle is completed.

As hereinafter described, during the time that the flag is set, a diagnosis is prohibited, and when the flag is reset, the diagnosis is started. If the temperature T of the engine cooling water is higher than 70° C. when the engine is started or immediately after the engine is started, the temperature of the carburetor 3 is considered to be very high. Consequently, at this time, since percolation may be generated, the diagnosis is prohibited to prevent an incorrect diagnosis.

In step 135, if it is determined that the fixed time has elapsed after the engine is started, the routine goes to step 136, and it is determined whether or not the temperature T of the engine cooling water is higher than a predetermined temperature, for example, 95° C.. If $T>95°$ C., the routine goes to step 138, and the flag is set. Consequently, the diagnosis is prohibited. If the temperature T of the engine cooling water is higher than 95° C. when the fixed time has elapsed after the engine is started, percolation may occur in the carburetor 3. Consequently, in this case, the diagnosis is prohibited to prevent an incorrect diagnosis.

If it is determined in step 132 that $T\leqq 70°$ C., that is, when the temperature T of the engine cooling water does not exceed 70° C. before the fixed time has elapsed after the engine is started, the routine goes to step 139. In addition, if it is determined in step 136 that $T\leqq 95°$ C., that is, when the temperature T of the engine cooling water does not exceed 95° C. when the fixed time has elapsed after the engine is started, the routine goes to step 139. In step 139, it is determined whether or not the flag is set. If the flag is reset, that is, when the temperature T of the engine cooling water does not exceed 70° C. before the fixed time has elapsed, or when the temperature T of the engine cooling water does not exceed 95° C. when the fixed time has elapsed after the engine is started, the routine goes to step 140.

In steps 140, 141, 142, 143, it is determined whether or not the engine is operating in a state wherein the diagnosis should be made, and when the diagnosis is made in steps 144, 145 and it is determined that the air-fuel ratio control device has malfunctioned, the process goes to step 146 and the warning lamp 22 is lit.

Namely, in step 140, it is determined whether or not the temperature T of the engine cooling water is lower than 60° C. If $T<60°$ C., the processing cycle is completed. Consequently, at this time, a diagnosis is not made. Consequently, when the fixed time has not elapsed after the engine is started, the diagnosis is made when $60° C.<T<70°$ C. Conversely, when the fixed time has elapsed after the engine is started, the diagnosis is made when $60° C.<T<95°$ C.

In step 141, it is determined whether or not the opening degree $\theta$ of the throttle valve 8 is smaller than 10°, on the basis of the output signal of the throttle sensor 12 and, in step 142, it is determined whether or not the level of vacuum P in the intake manifold 2 is larger than −80 mmHg and smaller than −350 mmHg, on the basis of the output signal of the vacuum pressure sensor 14. In addition, in step 143, it is determined whether or not the engine speed N is higher than 1500 r.p.m. and lower than 3000 r.p.m., on the basis of the output signal of the engine speed sensor 20.

In step 144, it is determined whether or not the control electric current I is larger than MIN and smaller than MAX. If I≦MIN, or if I≧MAX, the routine goes to step 145, and it is determined whether or not the state of I≦MIN or I≧MAX has continued for more than 10 sec. If this state has continued for more than 10 sec, it is determined that the air-fuel ratio control device has malfunctioned. At this time, the routine goes to step 146, and the warning lamp 22 is lit.

Conversely, if it is determined in step 139 that the flag is set, the routine goes to step 147, and it is determined whether or not the routine has gone through step 147 for the first time. When the routine has gone through step 147 for the first time, the routine goes to step 148, and the timer II is set. Then, the processing routine is completed.

In the next processing cycle, the routine goes from step 147 to step 149, and it is determined whether or not a fixed time determined by the timer II has elapsed after the timer II is set. If the fixed time has not elapsed, the processing cycle is completed. Conversely, if the fixed time has elapsed, the routine goes to step 150, and the flag is set. If the flag is set, the routine goes from step 139 to step 140 in the next processing cycle, and thus a diagnosis is made.

If the temperature T of the engine cooling water exceeds 70° C. before the fixed time has elapsed after the engine is started, the flag is set. Then, if the temperature T of the engine cooling water becomes lower than 70° C., since the routine goes from step 139 to step 147, the diagnosis is started when the fixed time has elapsed after the temperature T of the engine cooling water becomes lower than 70° C. In addition, if the temperature T of the engine cooling water exceeds 95° C. when the fixed time has elapsed after the engine is started, the flag is set. Then, if the temperature T of the engine cooling water becomes lower than 95° C., since the routine goes from step 139 to step 147, the diagnosis is started after the fixed time has elapsed after the temperature T of the engine cooling water becomes lower than 95° C. Namely, even if the temperature T of the engine cooling water becomes low, the temperature of the carburetor 3 does not always becomes low in accordance with a reduction in the temperature T of the engine cooling water. Consequently, even if the temperature T of the engine cooling water becomes lower than 70° C. or 90° C., percolation may be generated. Consequently, at this time, if the diagnosis is made, an incorrect diagnosis may be made. Consequently, in this embodiment, to prevent an incorrect diagnosis, even if the temperature T of the engine cooling water becomes lower than 70° C. or 95° C., the diagnosis is prohibited for a fixed time until the temperature of the carburetor 3 has fallen.

In this embodiment, an incorrect diagnosis is prevented by prohibiting the diagnosis for a fixed time until the temperature of the carburetor falls, even when the temperature of the engine cooling water has become lower than a predetermined temperature.

While the invention has been described by reference to specific embodiments chosen for purposes of illustration, it should be apparent that numerous modifications could be made thereto by those skilled in the art without departing from the basic concept and scope of the invention.

We claim:

1. A diagnostic system of an air-fuel ratio control device for use in an internal combustion engine, said diagnostic system comprising:

detecting means for detecting a temperature of the engine;

diagnostic means for determining whether or not said air-fuel ratio control device has malfunctioned; and control means for controlling said diagnostic means in response to an output signal of said detecting means to prohibit a determination by said diagnostic means when said temperature of the engine exceeds a predetermined temperature.

2. A diagnostic system according to claim 1, wherein said predetermined temperature is changed in accordance with a time elapsed after the engine is started.

3. A diagnostic system according to claim 2, wherein said predetermined temperature becomes equal to a first temperature before a fixed time has elapsed after the engine is started, and said predetermined temperature becomes equal to a second temperature which is higher than said first temperature when said fixed time has elapsed after the engine is started.

4. A diagnostic system according to claim 3, wherein said first temperature is about 70° C., and said second temperature is about 95° C.

5. A diagnostic system according to claim 1, wherein said control means causes said diagnostic means to determine whether or not said air-fuel ratio control device has malfunctioned when said temperature of the engine becomes lower than said predetermined temperature.

6. A diagnostic system according to claim 1, wherein said control means continues to prohibit said determination by said diagnostic means while the engine is operating once said temperature of the engine exceeds said predetermined temperature.

7. A diagnostic system according to claim 1, wherein said control means causes said diagnostic means to determine whether or not said air-fuel ratio control device has malfunctioned when said temperature of the engine becomes lower than another predetermined temperature which is lower than said predetermined temperature.

8. A diagnostic system according to claim 7, wherein said predetermined temperature and said other predetermined temperature are changed in accordance with a time elapsed after the engine is started.

9. A diagnostic system according to claim 8, wherein said predetermined temperature becomes equal to a first temperature before a fixed time has elapsed after the engine is started, and said predetermined temperature becomes equal to a second temperature which is higher than said first temperature when the fixed time has elapsed after the engine is started, said other predetermined temperature becoming equal to a third temperature which is lower than said first temperature before the fixed time has elapsed after the engine is started, said other predetermined temperature becoming equal to a fourth temperature which is lower than said second temperature when the fixed time has elapsed after the engine is started.

10. A diagnostic system according to claim 9, wherein said first temperature is about 70° C., said second temperature is about 95° C., said third temperature is about 65° C., and said fourth temperature is about 80° C.

11. A diagnostic system according to claim 1, wherein said control means causes said diagnostic means to determine whether or not said air-fuel ratio control device has malfunctioned when a fixed time has elapsed after said temperature of the engine becomes lower than said predetermined temperature.

12. A diagnostic system according to claim 1, wherein said control means prohibits said determination by said diagnostic means when said temperature of the engine becomes lower than a lower limit which is lower than said predetermined temperature.

13. A diagnostic system according to claim 12, wherein said lower limit is about 60° C.

14. A diagnostic system according to claim 1, further comprising a detector for detecting an opening degree of a throttle valve, wherein said control means controls said diagnostic means in response to an output signal of said detector to prohibit said determination by said diagnostic means when the opening degree of said throttle valve is smaller than a predetermined degree.

15. A diagnostic system according to claim 1, further comprising a detector for detecting a vacuum pressure in an intake passage of the engine, wherein said control means controls said diagnostic means in response to an output signal of said detector to prohibit said determination by said diagnostic means when a level of said vacuum pressure is smaller than a first level or larger than a second level which is larger than said first level.

16. A diagnostic system according to claim 1, further comprising a detector for detecting an engine speed, wherein said control means controls said diagnostic means in response to an output signal of said detector to prohibit said determination by said diagnostic means when said engine speed is lower than a first speed or higher than a second speed which is higher than said first speed.

17. A diagnostic system according to claim 1, wherein said detecting means comprises a detector for detecting the temperature of a coolant of the engine.

18. A diagnostic system according to claim 1, wherein said diagnostic means comprises a warning lamp which is lit when said diagnostic means determines that said air-fuel ratio control device has malfunctioned.

19. A diagnostic system according to claim 1, wherein said air-fuel ratio control device comprises an oxygen concentration detector arranged in an exhaust passage of the engine, a carburetor arranged in an intake passage of the engine, and an electric air-fuel ratio control valve controlling an air-fuel ratio in response to an electric control current changed in accordance with a change in an output signal of said oxygen concentration detector to make the air-fuel ratio equal to a predetermined air-fuel ratio, said diagnostic means determining whether or not said air-fuel ratio control device has malfunctioned on the basis of said electric control current.

20. A diagnostic system according to claim 19, wherein said electric control current normally varies between a predetermined upper limit and a predetermined lower limit, and said diagnostic means determines that said air-fuel ratio control device has malfunctioned when said electric control current reaches one of said upper limit and said lower limit.

21. A diagnostic system according to claim 20, wherein said diagnostic means determines that said air-fuel ratio control device has malfunctioned when said electric control current is maintained at one of said upper limit and said lower limit for a fixed time.

22. A diagnostic system according to claim 19, wherein said carburetor comprises a fuel passage which is open to said intake passage, and an air bleed passage connected to said fuel passage, said electric air-fuel ratio control valve being arranged in said air bleed passage to control an amount of air fed into said fuel passage from said air bleed passage.

23. A diagnostic system according to claim 19, wherein said intake passage comprises an air supply passage which is open to said intake passage, and said electric air-fuel ratio control valve is arranged in said air supply passage to control an amount of air fed into said intake passage from said air supply passage.

* * * * *